United States Patent [19]

Font

[11] Patent Number: 4,593,910

[45] Date of Patent: Jun. 10, 1986

[54] BOARD GAME

[75] Inventor: Linda T. Font, Rio Piedras, P.R.

[73] Assignee: Commonwealth of Puerto Rico, P.R.

[21] Appl. No.: 709,130

[22] Filed: Mar. 7, 1985

[51] Int. Cl.[4] ..... A63F 3/00

[52] U.S. Cl. ..... 273/273; 273/280; 273/284; 273/287

[58] Field of Search ..... 273/236, 241, 265, 273, 273/280, 284, 272, 148 R

[56] References Cited

U.S. PATENT DOCUMENTS

| | | | |
|---|---|---|---|
| 1,597,562 | 8/1926 | Allen | 273/273 |
| 2,008,189 | 7/1935 | Rippon | 273/273 |
| 3,126,205 | 3/1964 | Jordan | 273/273 |
| 3,195,896 | 7/1965 | Markham | 273/273 |
| 3,427,028 | 2/1969 | Abrahamsen | 273/272 |
| 4,312,700 | 2/1982 | Dylag | 273/148 R |
| 4,384,722 | 5/1983 | Higgins | 273/280 |

OTHER PUBLICATIONS

Games, Master Mind Advertisement, Mar. Apr. 1979.

*Primary Examiner*—Richard C. Pinkham
*Assistant Examiner*—Benjamin Layno
*Attorney, Agent, or Firm*—Scrivener Clarke Scrivener and Johnson

[57] ABSTRACT

A game is played by two teams of two players who are positioned about the four sides of a rotatable playing board. The play area of each player is shielded from the others by four vanes which extend radially at 90° spacings from a shaft mounted on the playing board. The board, shaft and vanes are rotatable through 180°. Identical play cards, information cards and pins are distributed to the players and the play cards are provided with holes corresponding to data on the information cards. The players place their play cards on their play areas and each player attempts to insert a pin in each correct hole.

1 Claim, 12 Drawing Figures

BOARD GAME

SUMMARY OF THE INVENTION

A game to be played by two teams of two persons each has a preferably rectangular playing board with a shaft extending vertically upward from its center, from which four vertical planar opaque vanes extend radially outwardly at 90° spacing to provide between adjacent vanes a playing space for each player, the board, shaft and vanes being rotatable through 180° under the control of the players. The players are provided with identical play pieces marked with informative material identified by holes, and the play pieces are placed on the playing board in the play space defined by the two vanes before each player. Pins marked to relate to the informative material on the play pieces, and information cards containing informative material related to that on the play pieces are distributed to each player. The players study the information cards, then discard them, and then attempt to correctly position the pins in the holes in the play pieces in exact conformity to the informative material on the cards.

DESCRIPTION OF THE INVENTION

Figure 1:
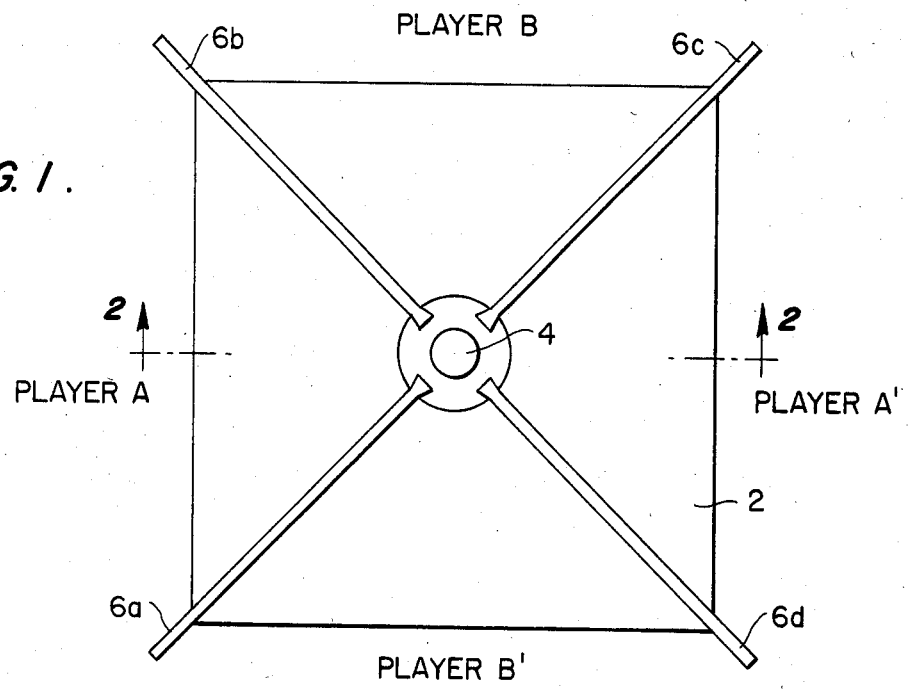
FIG. 1 is a plan view of the game board provided by the invention.
Figure 2:
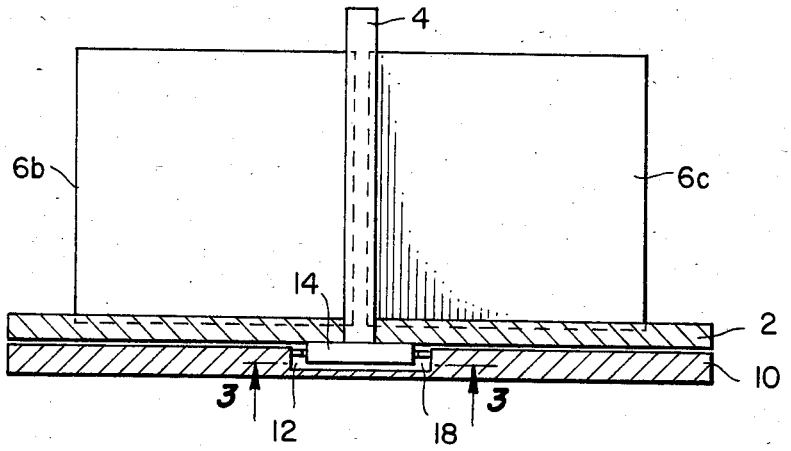
FIG. 2 is a side view of the game board, with parts in sectional view.
Figure 3:
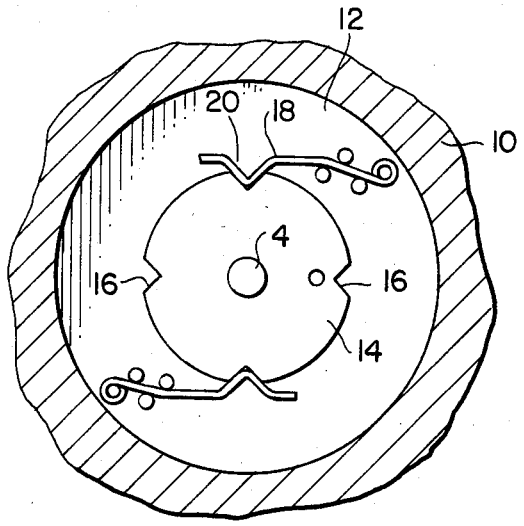
FIG. 3 is a sectional view taken on line 3—3 of FIG. 2.

The preferred embodiment of the game apparatus provided by the invention is illustrated in the drawings and comprises, first, a rectangular flat game board 2 the upper surface of which forms the playing surface for two players, A, A′ who sit opposite each other and constitute a team, and two players B, B′ who sit opposite each other and form a second team. A shaft 4 extends upwardly from the center of the playing field for a height of about four inches and supports four identical vertical planar opaque vanes *6a*, *6b*, *6c*, *6d* which extend radially from the shaft at 90° intervals. Means are provided for rotating the game board and the shaft through 180°, and preferably take the form shown in FIGS. 2 and 3 and comprise, first, a base plate 10 which underlies the game board 2 and is preferably of the same lateral size and is fixed from rotation by engagement with the underlying fixed surface, which may be a table top. The base has a central opening 12 therein within which is positioned a wheel 14 which is fixed to the lower end of shaft 4 and to the rotatable game board 2. The periphery of the wheel is provided at 90° intervals with notches 16, and two leaf springs 18, each of which has a V-shaped end part 20 which bears upon the periphery of the wheel, are connected at their outer ends to the peripheral wall of the central opening 12 in the base plate 10. It will be apparent that in playing a game, as will be described later in this specification, the rotatable assembly consisting of the four vanes *6a*, *6b*, *6c*, *6d*, shaft 4 and wheel 14 may be rotated by using the fingers to grasp the shaft or vanes, and that the rotatable assembly may be moved through 180°, as required by the rules of the game, and held in the adjusted position by engagement of the V-shaped end parts of the leaf springs within the notches in the periphery of the wheel 14. Power or other means for rotating the vanes, and signal means for indicating their position, may be provided within the scope of the invention.

Figure 4:
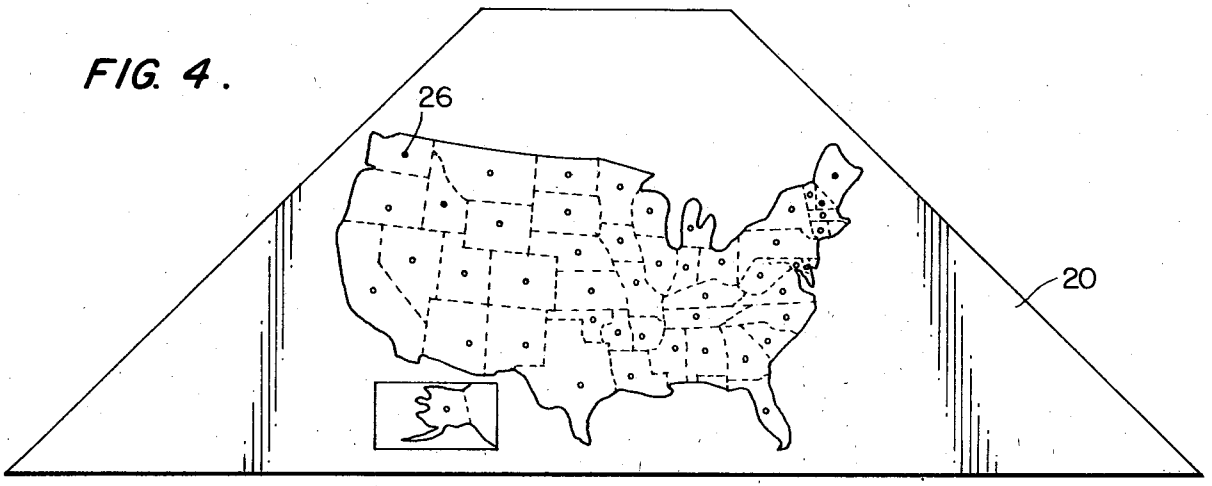
FIG. 4 is a plan view of a play piece used in playing a specific game.
Figure 5:
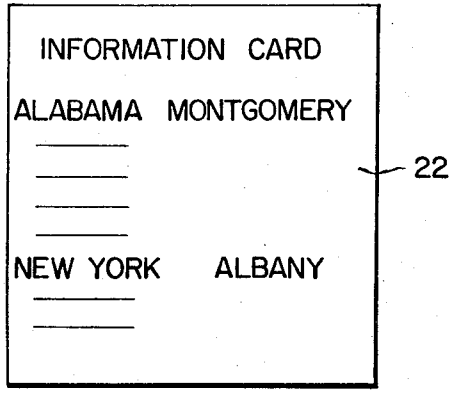
FIG. 5 is a plan view of an information card used in playing the same game.

Associated with the game board 2 for each of the almost infinite number of games which may be played using the apparatus are four game pieces 20, four information cards 22 and a plurality of headed pins 24. The game pieces are cards, all of a size to be placed on the upper surface of the game board between the adjacent vanes in front of a player, as shown in FIG. 4, and the information cards are of any desired size with the information printed on one or both sides, as shown in FIG. 5.

Figure 6:
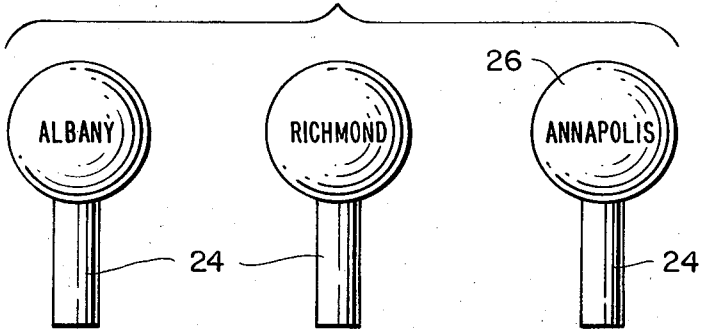
FIG. 6 is a view of typical pins used in playing the game in which the parts of FIGS. 4 and 5 are used.

In the game now to be described each of four game pieces 20 has on it the map of the United States of America, divided into the states, and the location of each state capital city is marked by a hole, one of which is shown at 26. In this game each of the four information cards 22 has printed on it the name of each state of the United States and the name of its capital city, as partially shown in FIG. 5 for purposes of illustration. The pins 24 for this game are shown in FIG. 6 and each pin has a large head 26, each of which in the game being described is marked with the names of a state capital city. In playing the game the players A, A′ are seated opposite each other and form a team, and the players B, B′ are seated opposite each other and form a second team, and each player faces a playing field defined by two of the vanes and shaped as a right triangle with the 90° angle at the center of the game board. The four play pieces 20 are now distributed and each player places it in the playing quadrant which he faces. In the game being described each play piece shows the map of the United States, as described. The four information cards, listing the states of the United States and their capital cities, are now distributed and are studied by the players for a time specified in the rules of the game, for example one minute, and are then returned to the card pack. The players now take the pins and attempt to place each of them in the hole marking the capital city of a state, for example placing the pin marked "Sacramento" in the hole marking the location of the capital city of California. After a specified time, for example one minute, the shaft, the vanes and the rotatable playing field are rotated 180° presenting each player with the play piece on which his team partner has been working. Each player now attempts to complete or correct what his team partner has done, and in a specified time after rotation of the playing field the game ends and the accuracy of the play by the teams is compared and the winning team declared.

Figure 7A:
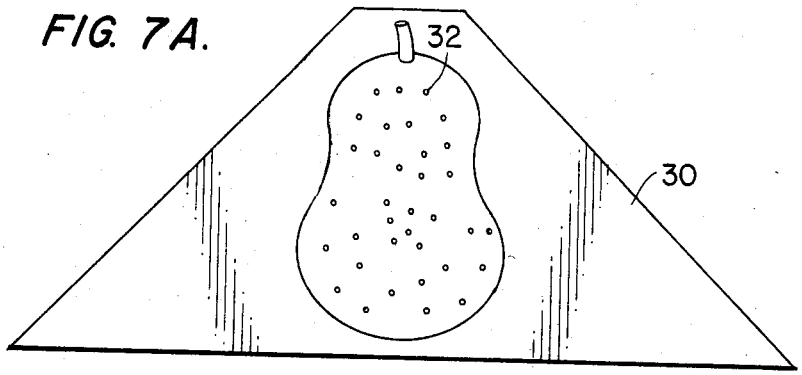
FIGS. 7A, 7B and 7C show, respectively, the play pieces, information cards and typical pins used in playing another game.
Figure 7B:
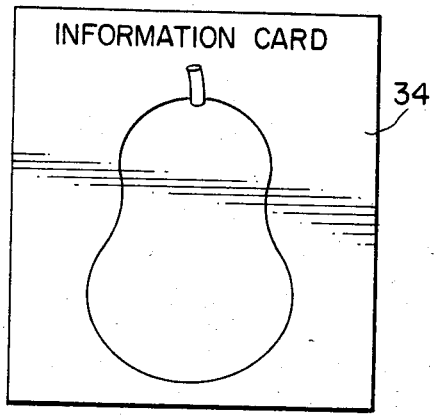
Figure 7C:
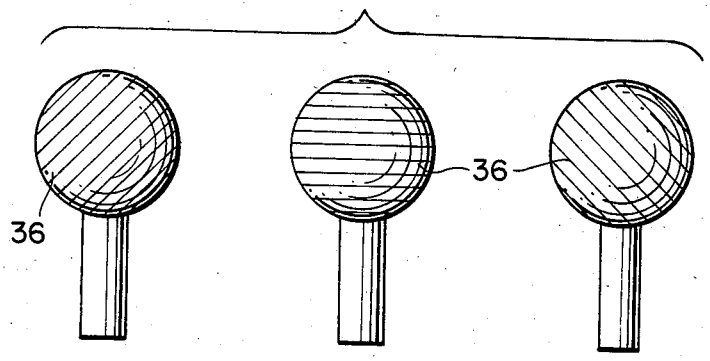

Another game played with the same basic apparatus is illustrated in FIGS. 7A, 7B, 7C in which each of the four play pieces 30 has on it the representation of a pear, as shown in FIG. 7A, with holes 32 distributed over the colored areas but without any indication of what color each hole or group of holes represents. Each of the four information cards 34 has on it the representation of the same pear with the colored areas in their true colors, as shown in FIG. 7B. The heads of the pins 36 shown in FIG. 7C are variously colored in the colors included in the representation of a pear on the information card and each player first studies the colors on the information card then discards the card, then attempts to correctly color the pear shown on the play piece using the pins, and after a set time the players of each team exchange un-finished play pieces by rotating the vanes of the game board.

Figure 8A:
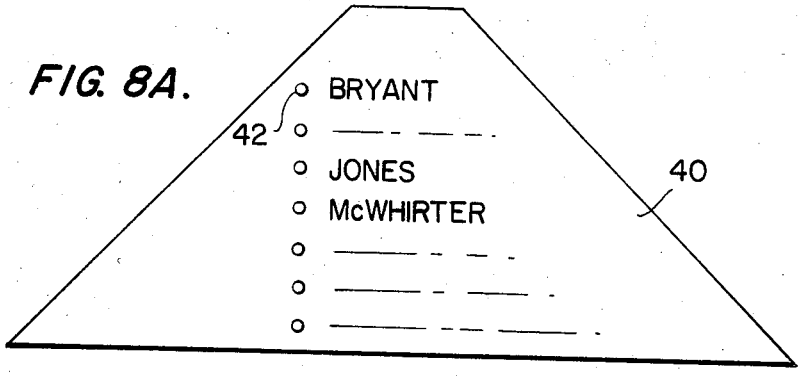
FIGS. 8A, 8B and 8C show, respectively, the play pieces, information cards and typical pins used in playing still another game.
Figure 8B:
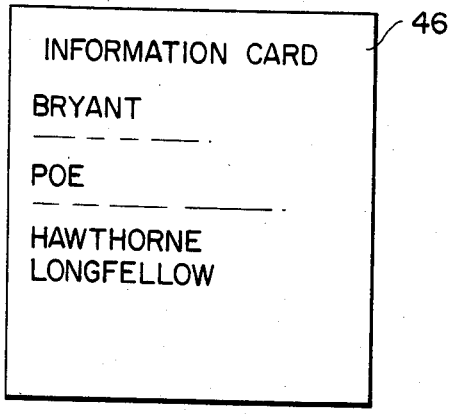
Figure 8C:
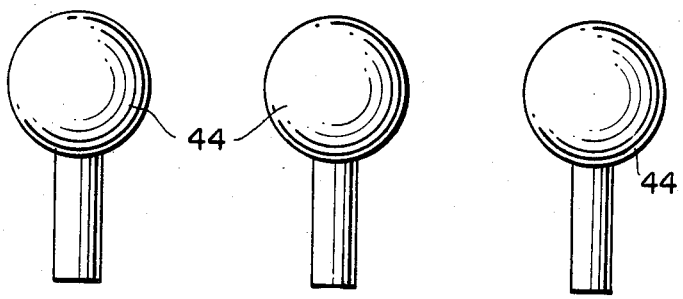

In another form of the game, parts of which are shown in FIGS. 8A, 8B and 8C each of the four play pieces 40 contains a list of persons having various different occupations, only some of such persons being poets, and adjacent each of which names is a hole 42 for receiving one of the blank headed pins 44. The information card 46 contains a list of persons all of when are poets, and in playing the game each player studies the information card, then discards it, and then tries to place a pin in each of the holes adjacent the name of a poet.

It will be apparent to those skilled in the pertinent arts that games other than those described may be devised and played using the basic apparatus provided by the invention.

I claim:

1. A game to be played by two opposing teams of two players each, comprising (a) a playing board, (b) a vertical upwardly extending shaft mounted at the center of the playing board, (c) four vertical flat opaque vanes mounted on the shaft and extending radially outwardly from it at 90° intervals, thereby defining four playing areas on the upper surface of the playing board, (d) means for rotating the playing board and shaft through 180°, (e) a pack of four identical play pieces each of which is adapted to be placed on one of the four playing areas and each of which is marked with items of informative material marked by holes in the play pieces, (f) a pack of four identical information cards each of which contains in random fashion information related to the hole-marked informative material on the play pieces, and (g) a plurality of headed pins for each player, the head of each of which is marked with informative material related to that on the playing pieces and the informaticn cards, and which are adapted and intended in accordance with the rules of the game to be inserted in the holes of the playing pieces in accordance with the information on the information cards.

* * * * *